US005803299A

United States Patent [19]

Sealy, Jr.

[11] Patent Number: 5,803,299

[45] Date of Patent: Sep. 8, 1998

[54] CONTAINER FOR MULTIPLE TRASH BAGS

[76] Inventor: Scott P. Sealy, Jr., 5750 E. University, Apt. 427, Dallas, Tex. 75206

[21] Appl. No.: 692,403

[22] Filed: Aug. 5, 1996

[51] Int. Cl.[6] ..... B65D 90/04

[52] U.S. Cl. ..... 220/404; 248/99

[58] Field of Search ..... 220/404, 406; 248/99, 100

[56] References Cited

U.S. PATENT DOCUMENTS

| | | | |
|---|---|---|---|
| 2,324,440 | 7/1943 | Tormohlen | 220/65 |
| 3,888,406 | 6/1975 | Nippes | 229/14 |
| 4,418,835 | 12/1983 | Watts | 220/404 |
| 4,715,572 | 12/1987 | Robbins, III et al. | 220/404 |
| 4,901,959 | 2/1990 | Stage | 220/404 |
| 4,923,087 | 5/1990 | Burrows | 220/404 |
| 4,978,231 | 12/1990 | Ling et al. | 383/11 |
| 4,989,994 | 2/1991 | Gelbard | 383/37 |
| 5,058,763 | 10/1991 | Dickinson | 220/404 |
| 5,065,891 | 11/1991 | Casey | 220/404 |
| 5,222,704 | 6/1993 | Light | 220/404 |
| 5,363,980 | 11/1994 | Mulcahy | 220/404 |
| 5,478,152 | 12/1995 | Bogle | 220/404 |
| 5,492,242 | 2/1996 | Gall | 220/406 |
| 5,520,303 | 5/1996 | Bernstein et al. | 220/404 |

*Primary Examiner*—Joseph M. Moy
*Attorney, Agent, or Firm*—John M. Harrison

[57] ABSTRACT

A container for multiple, nested trash bags, characterized by a container body having bag supports extending into the container body for suspending multiple, nested trash bags in the container in open, trash-receiving configuration. The nested trash bags are placed inside the container body in open configuration and the bag supports are inserted through respective openings provided in the trash bags. After the innermost trash bag has been filled to capacity with trash, the bag is removed from the supports, gathered, sealed and lifted from the container, leaving the second inner bag in position to receive trash. In another embodiment, the supports extend inwardly from a bag support insert which is removably or fixedly mounted on the upper open end of the container body.

2 Claims, 4 Drawing Sheets

FIG. 1
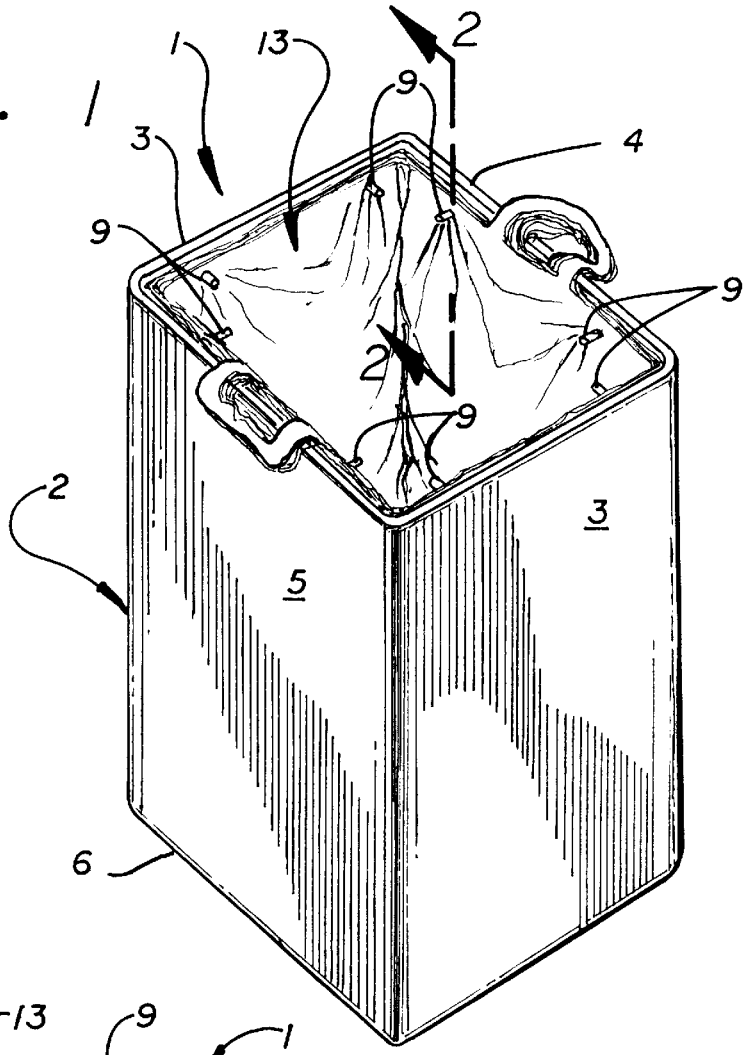
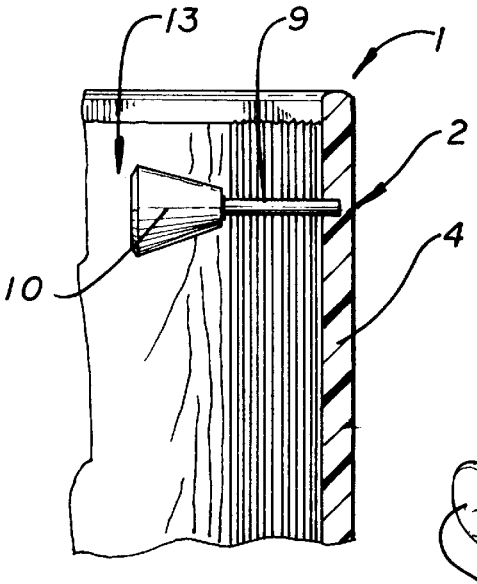
FIG. 2
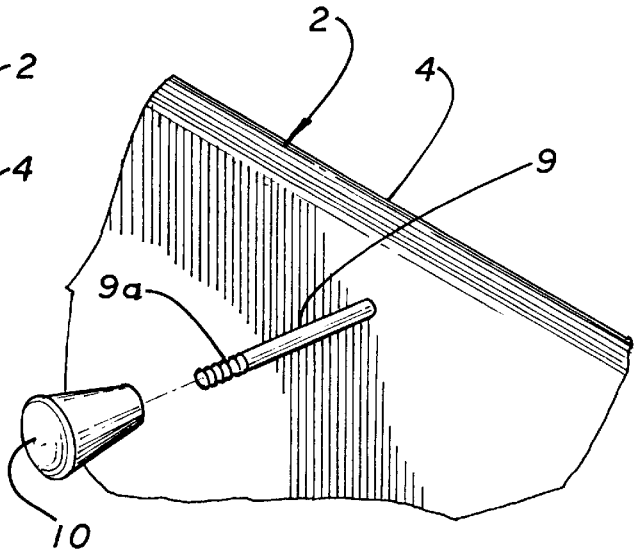
FIG. 3

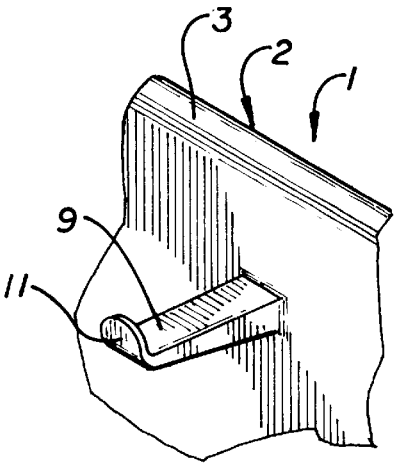
FIG. 4
FIG. 5
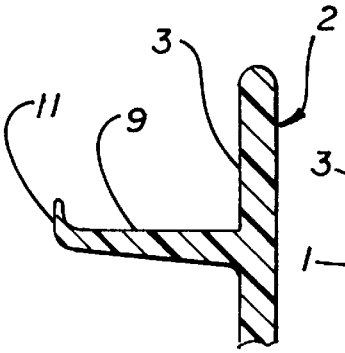
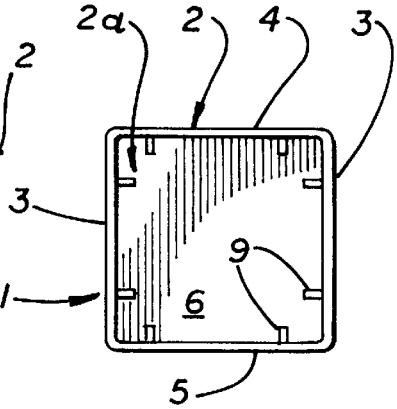
FIG. 8
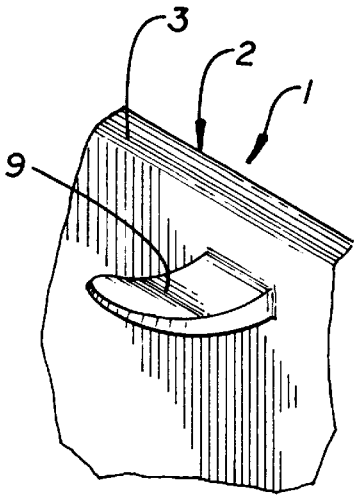
FIG. 6
FIG. 7
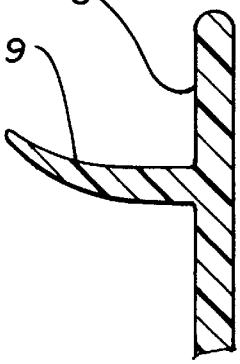
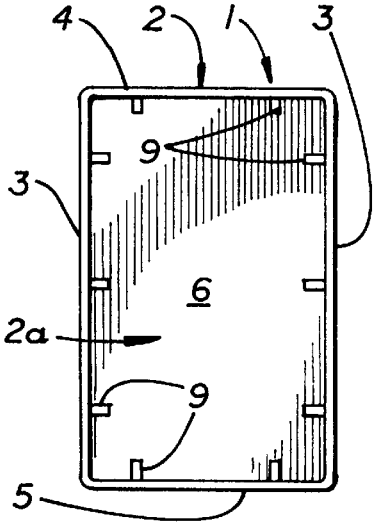
FIG. 9
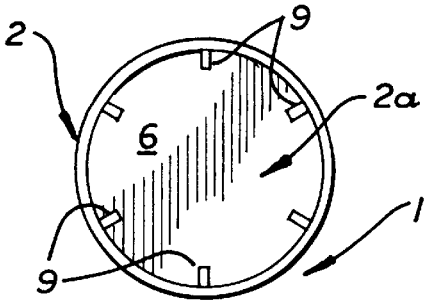
FIG. 10
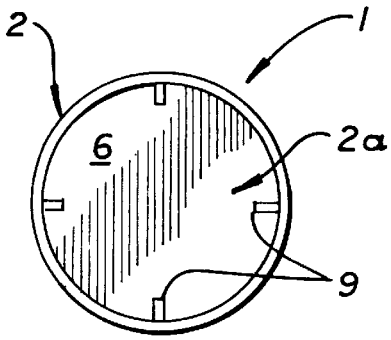
FIG. 11

CONTAINER FOR MULTIPLE TRASH BAGS

BACKGROUND OF THE INVENTION

1. Field of the Invention

This invention relates to trash receptacles and more particularly, to a container for holding multiple, nested trash bags in open configuration for receiving trash. In a preferred embodiment the container is characterized by a square, rectangular or circular container body having multiple bag supports, such as pegs extending inwardly from the walls of the container body into the container body interior. The trash bags are placed in the container body in open configuration and the bag support pegs inserted through respective slots provided adjacent to the open end of the trash bags. After the innermost trash bag has been filled to capacity with trash, the bag is removed from the pegs, gathered, sealed and lifted from the container, leaving the innermost bag in position to receive trash. In a preferred embodiment a retainer cone is threaded or otherwise provided on each of the bag support pegs for retaining the trash bags on the respective pegs. In another embodiment a retainer flange is shaped in the end of each peg and in still another embodiment, the bag support pegs extend from a bag support insert, which is removably or fixedly mounted on the open end of the container body.

2. Description of the Prior Art

Many different types of receptacles are known for holding trash bags in an open configuration for receiving trash. Most of these receptacles, however, are inefficient for use when frequent replacement of trash bags is required. For example, because typical trash bag receptacles are designed to carry only a single bag at a time, it is necessary when these receptacles are used, to replace the bag after it has been filled to capacity. This procedure not only requires the person changing the bag to carry a supply of replacement bags with them, but also often requires an appreciable amount of time to change the bag.

Typical of containers known in the art for receiving and containing trash or for holding one or more trash bags in open configuration for receiving trash are as follows: A "Waste Container" is detailed in U.S. Pat. No. 2,324,440, dated Jul. 13, 1943, to Blanche M. Formohlen. The waste container is characterized by a container enclosure for receiving single or nested trash bags, the edges of which are pulled over the sides of the enclosure such that the bags are suspended in the enclosure in open configuration. U.S. Pat. No. 3,888,406,dated Jun. 10, 1975, to Timothy Nippes, describes a "Trash Disposal Apparatus" characterized by a support collar for attachment to a trash receptacle and supporting multiple, nested trash bags in the receptacle. The edges of the trash bags are pulled over the support collar and removably attached to notches in the outer surface of the support collar, to facilitate removal of the innermost bag from the trash receptacle when the bag is filled to capacity, as well as provide a replacement bag which is already properly positioned in the receptacle upon removal of the filled, innermost bag. U.S. Pat. No. 4,418,835, dated Dec. 6, 1983, to Abner W. Watts, details a "Trash Container Apparatus" characterized by a container having a pair of brackets therein for supporting a plastic trash bag in open configuration. A "Trash Storage and Disposal Combination Unit" is disclosed in U.S. Pat. No. 4,923,087, dated May 8, 1990, to Roger A. Burrows. The unit is characterized by a trash container for supporting one or several nested, handled trash bags in open, trash-receiving configuration. The edges of the bags are pulled over the edges of the container and the handles of the bags are retained by hooks provided on the sides of the container. U.S. Pat. No. 4,978,231, dated Dec. 18, 1990, to Zhang A. Ling, describes a "Multiple Disposable Plastic Bag Assembly" characterized by multiple, disposable plastic bags which are nested to form a bag assembly. Adhesive elements are provided near the edge of the opening of the bag assembly for adhering the bag assembly to a waste container and allowing the bags of the bag assembly to be torn up consecutively as they are used, in order to minimize time consumption in placing individual bags in a waste bin. "Nested Plastic Bags and Method of Manufacture" are detailed in U.S. Pat. No. 4,989,994, dated Feb. 5, 1991, to Edward S. Gelbard. The nested plastic bags are used for lining containers such as garbage cans or waste paper baskets, and are manufactured by first placing multiple plastic bags over a jig. The upper edges of the plastic bags are then adhered to each other by heat sealing, for example, such that the innermost bag in the assembly may be separated readily from the remaining bags after the assembly has been placed in a container. U.S. Pat. No. 5,363,980, dated Nov. 15, 1994, to Stephen J. Mulcahy, details a "Combination Disposable Waste Container" characterized by a substantially rigid shell, to which a stack of nested plastic bags is attached for support. The bags are serially separable from each other and the outermost of the bags is permanently attached to the shell for ultimate disposal therewith. The entire unit is collapsible by flattening the shell with the bag stack mounted therein for ease in transportation and storage. U.S. Pat. No. 5,492,242, dated Feb. 20, 1996, to Karsten Gall, discloses a "Container For Fluids or Fluid-Like Products", characterized by a container having a series of protective layers which are applied to the container walls and can be pulled off along with adhering contamination, such that the container may be reused again without having to clean the container.

An object of this invention is to provide a new and improved container for supporting multiple, nested trash bags in an open configuration for receiving trash.

Another object of this invention is to provide a container for multiple trash bags, which container is characterized by a container body having multiple bag supports extending into the container body for extension through the trash bags or through slots provided in the nested trash bags, to suspend the trash bags in the container body in open configuration for receiving trash.

Still another object of this invention is to provide a container for multiple trash bags, characterized by a container body having a bag support insert mounted on the open end thereof and multiple bag supports, such as pegs, extending from the bag support insert into the container interior, for suspending a series of nested trash bags in the container in open, trash-receiving configuration.

Yet another object of this invention is to provide a container for multiple trash bags, which container is characterized by a container body having multiple bag support pegs extending into the container body for suspending multiple, nested trash bags in the container in open, trash-receiving configuration, which bag support pegs each include a retainer cone threaded or otherwise provided on the end thereof for retaining the trash bags on the pegs.

Summary of the Invention

These and other objects of the invention are provided in a container for receiving and storing multiple, nested trash bags, which container is characterized by a container body of selected shape having multiple, spaced bag supports, such as pegs, extending into the container body for extension through the bags or through slots provided in the bags and which trash bags are thusly suspended in the container body in open configuration such that the innermost bag is positioned for receiving trash. In another embodiment the bag support pegs extend from a bag support insert, which is removably or fixedly mounted on the open end of the container body. In still another embodiment a retainer cone is threaded or otherwise provided on each bag support peg for retaining the trash bags on the pegs and in yet another embodiment, a retainer flange is formed or shaped in the end of each bag support peg for retaining the trash bags on the pegs.

BRIEF DESCRIPTION OF THE DRAWINGS

The invention will be better understood by reference to the accompanying drawings, wherein:

FIG. 1 is a perspective view of a preferred embodiment of the container for multiple nested trash bags of this invention;

FIG. 2 is a sectional view, taken at section line 2—2 in FIG. 1, of the container for multiple, nested trash bags, more particularly illustrating typical bag support peg and retainer cone elements of a preferred embodiment of the container;

FIG. 3 is a perspective view, partially in section, of typical bag support peg and retainer cone elements of the container, more particularly detailing a threading technique for removably mounting the retainer cone on the peg;

FIG. 4 is a perspective view, partially in section of bag support peg and retainer flange elements of yet another embodiment of the container;

FIG. 5 is an enlarged sectional view of the bag support peg and retainer flange elements illustrated in FIG. 4;

FIG. 6 is a perspective view, partially in section, of bag support peg elements of still another embodiment of the container;

FIG. 7 is an enlarged sectional view of the bag support peg illustrated in FIG. 6;

FIG. 8 is a top view of a preferred embodiment of the container;

FIG. 9 is a top view of another preferred embodiment of the container;

FIG. 10 is a top view of still another preferred embodiment of the container;

FIG. 11 is a top view of yet another preferred embodiment of the container;

DESCRIPTION OF THE PREFERRED EMBODIMENTS

Figure 12:
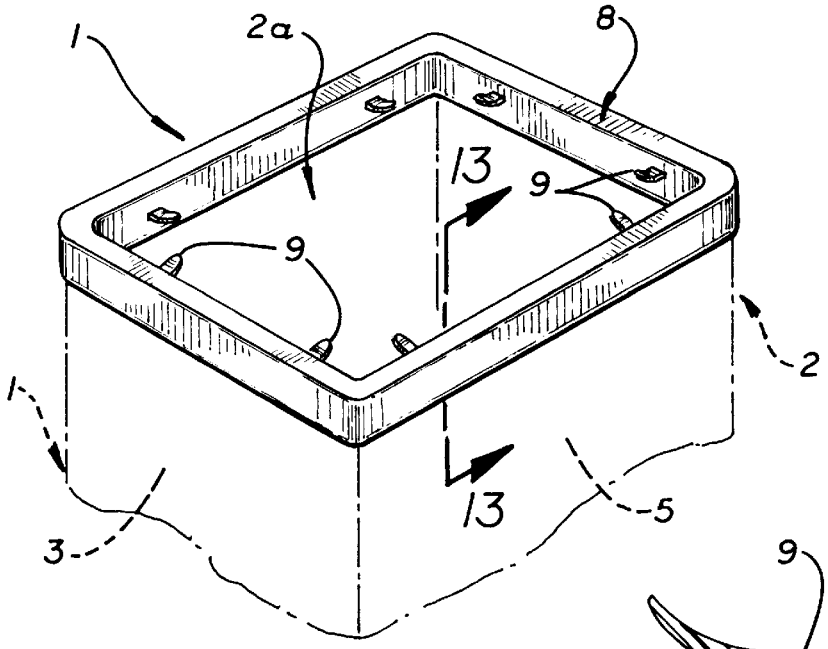
FIG. 12 is a perspective view, partially in section of a bag support insert embodiment of the container.

Referring initially to FIGS. 1–9 of the drawings, in a preferred embodiment the container for multiple trash bags, hereinafter referred to as the "container" of this invention, is generally illustrated by reference numeral 1. The container 1 includes a container body 2, typically having a substantially square or rectangular cross-sectional configuration, as illustrated in FIGS. 8 and 9, respectively. The container body 2 includes a bottom panel 6 (illustrated in FIGS. 8 and 9) and a pair of spaced side panels 3, and a front panel 5, spaced from a rear panel 4, extending upwardly from the bottom panel 6, defining a container interior 2*a*. At least two bag support pegs 9 extend from the interior surface of each side panel 3, front panel 5 and rear panel 4 into the container body 2, just below the upper edge of the container body 2. Each bag support peg 9 may be injection-molded, threaded into or otherwise attached to the corresponding side panel 3, rear panel 4 and front panel 5. As illustrated in FIG. 1, a series of nested trash bags 13 are preferably provided with peg slots (not illustrated) for receiving the respective bag support pegs 9, and are suspended on the bag support pegs 9 into the container body 2 in open configuration, such that the innermost trash bag 13 is positioned for receiving trash (not illustrated). As illustrated in FIGS. 2 and 3, in a most preferred embodiment, each bag support peg 9 includes peg threads 9*a* and a bag retainer cone 10 is threaded on each bag support peg 9, for removably retaining the trash bag or bags 13 on the bag support pegs 9. Alternatively, as illustrated in FIGS. 4 and 5, in a second embodiment an upward-turned retainer flange 11 is formed in the extending end of the bag support peg 9, for retaining the trash bag or bags 13 on the bag support pegs 9. In a third embodiment, the bag support peg 9 is curved or bent slightly upwardly, as illustrated in FIGS. 6 and 7, for removably retaining the trash bags on the bag support pegs 9. After the innermost trash bag 13 has been filled to capacity with trash, the innermost trash bag 13 is removed from the bag support pegs 9 and then gathered, sealed and lifted from the container 1, leaving the remaining innermost trash bag 13 in open position to receive trash.

Referring next to FIGS. 10 and 11 of the drawings, in yet another preferred embodiment of the invention the container body 2 has a substantially circular cross-sectional configuration. At least three, and preferably about six, bag support pegs 9 extend from the container body 2 into the container interior 2*a*. The nested trash bags 13 are suspended by the bag support pegs 9 in the container interior 2*a*, as described above with respect to the previous embodiments illustrated in FIGS. 1–9.

Figure 13:
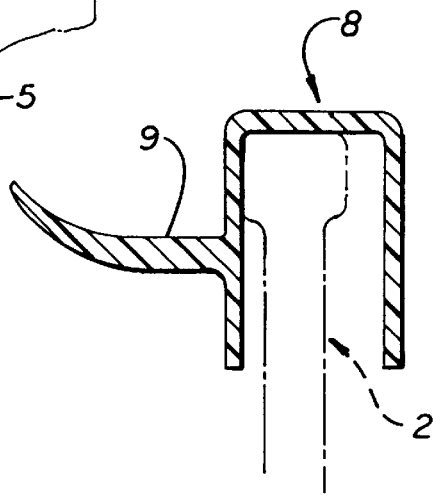
FIG. 13 is an enlarged sectional view taken at section line 13—13 in FIG. 12, of the bag support insert of the container, more particularly detailing a preferred technique for removably mounting the bag support insert on the container body (illustrated in phantom).
Figure 14:
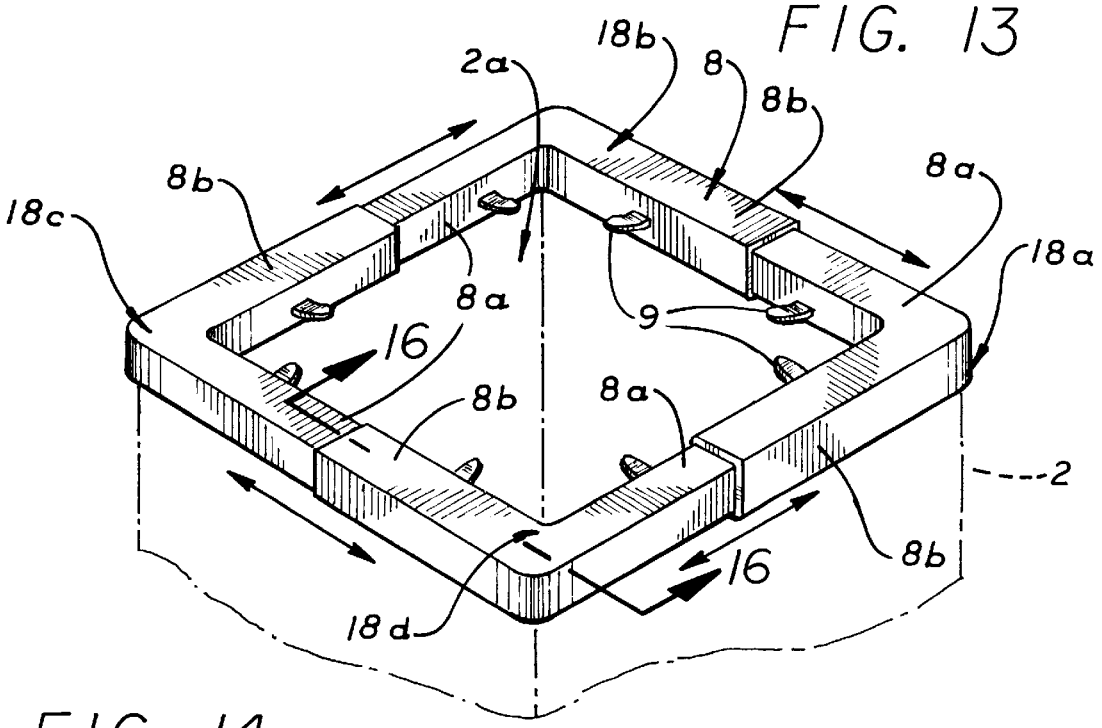
FIG. 14 is a perspective view, partially in section, of an adjustable bag support insert embodiment of the container.
Figure 16:
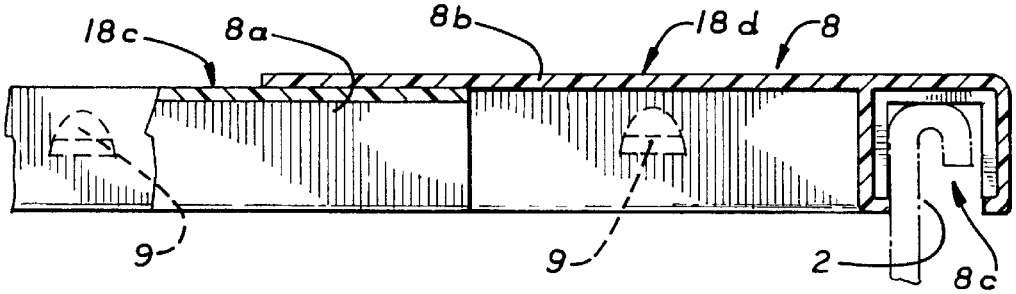
FIG. 16 is an enlarged sectional view taken along section line 16—16 in FIG. 14 of the bag support insert of the container.

Referring finally to FIGS. 12–16 of the drawings, in a still further embodiment of the invention a bag support insert 8 is removably or fixedly mounted or seated on the upper end or edge of the container body 2. Multiple bag support pegs 9, each optionally having a retainer cone 10, retainer flange 11 or upward curvature (illustrated in FIGS. 6, 7 and 13) for retaining the trash bags 13 on the bag support pegs 13, extend from the bag support insert 8 into the container interior 2*a*, as illustrated in FIGS. 12 and 13. Each bag support insert 8 may be constructed in a single piece, as illustrated in FIG. 12, or assembled for adjustable operation from four similar insert segments 18*a*–18*d*, as illustrated in FIG. 14. Each hollow, L-shaped insert segment 18*a*–18*d* includes a male member 8*a* and a perpendicular female member 8*b*, having a larger cross-sectional area than the male member 8*a*. A continuous insert channel 8*c* is included in the bottom surface of each male member 8*a* and female member 8*b* of each insert segment 18, for receiving and removably mounting the bag support insert 8 on the top edge of the container body 2, as hereinafter further described. Each bag support insert 8 is assembled by consecutively inserting the male member 8*a* of the first insert segment 18*a* in the female member 8*b*of the second insert segment 18*b*, the male member 8*a* of the second insert segment 18*b* in the female member 18*b* of the third insert segment 18*c*, the male member 8*a* of the fourth insert segment 18*d* into the female member 18*b* of the first insert segment 18*a* and finally, the male member 8*a* of the third insert segment 18*c* in the female member 8*b* of the fourth insert segment 18*d*, to complete the square or rectangular bag support insert 8. As illustrated in FIG. 16, the bag support insert 8 is removably mounted on the container body 2 by inserting the upper edges of the container body 2 through the corresponding continuous insert channel 8c and resting the bag support insert 8 on the container body 2.

Figure 17:
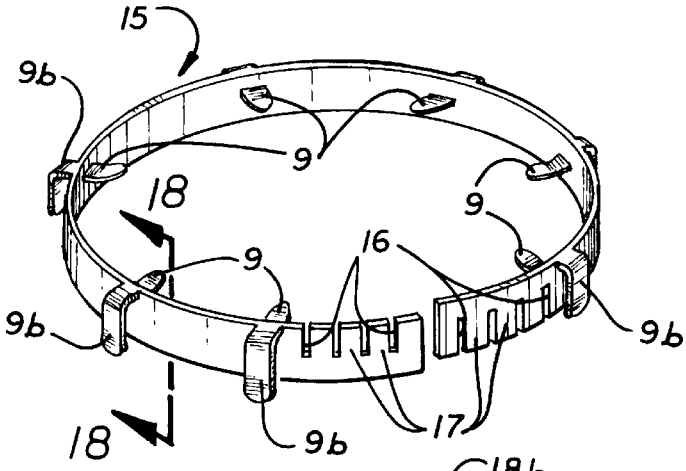
FIG. 17 is a perspective view of an adjustable round bag support insert element of still another embodiment of the container.
Figure 18:
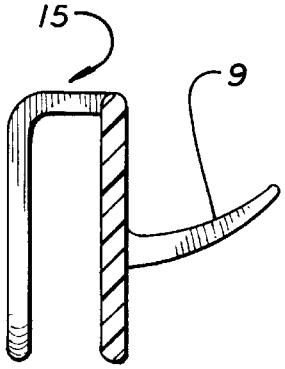
FIG. 18 is an enlarged sectional view, taken along section line 18—18 in FIG. 17 of the adjustable bag support insert.
Figure 15:
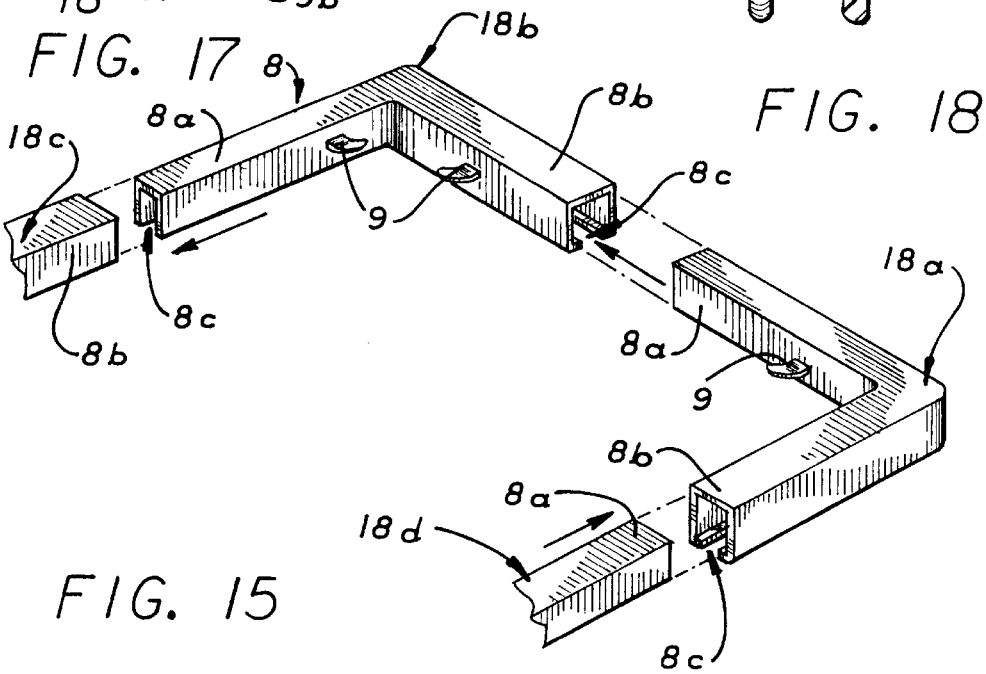
FIG. 15 is an exploded, perspective view of the adjustable bag support insert element of the container illustrated in FIG. 14.

Referring now to FIGS. 17 and 18 of the drawings, in yet another preferred embodiment the bag support insert 8 is characterized by a round adjustable bag insert 15, which is removably mounted on a container body 2 having the circular cross-sectional configuration illustrated in FIGS. 10 and 11. The round adjustable bag insert 15 is typically constructed from a deformable, resilient plastic material and includes a selected number of top and bottom adjusting notches 16 in each end thereof, defining a corresponding number of adjusting tabs 17. Multiple bag support pegs 9, each including a clip portion 9*b* for supporting the round adjustable bag insert 15 in the container interior 2*a*, as hereinafter further described, are molded with or inserted through respective slots (not illustrated) in the round adjustable bag insert 15, in spaced relationship. Alternatively, as illustrated in FIG. 18, the round adjustable bag insert 15 may have an inverted U-shaped cross-sectional configuration for receiving the edge of the container body 2, with the bag support pegs 9 extending directly from the round adjustable bag insert 15 in spaced relationship. The round adjustable bag insert 15 is removably fitted on a circular container body 2 having a selected diameter, by inserting a selected number of adjusting tabs 17 provided on one end of the round adjustable bag insert 15, in the respective adjusting notches 16 provided in the other end of the round adjustable bag insert 15, such that the round adjustable bag insert 15 fits in the container interior 2*a* in the upper end of the container body 2. The clip portion 9*b* of each bag support peg 9 is then fitted over the upper edge of the container body 2, with the round adjustable bag insert 15 suspended in the container interior 2*a*. The trash bags 13 are suspended in the container interior 2*a* in open configuration by inserting the bag support pegs 9 through the respective peg slots (not illustrated) as heretofore described.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A container for multiple trash bags, comprising a container defining a container interior a bag support insert having telescoping insert members fitted on said container, said bag support insert members extending into said container interior and bag support means extending from said bag support insert members into said container interior in spaced relationship with respect to each other for suspending the trash bags in said container interior.

2. A container for removably receiving multiple nested trash bags, said container comprising a container enclosure having four sides and a bottom, defining a container interior, a bag support insert having telescoping insert members fitted on said container, and at least two bag support pegs extending from said bag support insert members into said container interior in spaced relationship with respect to each other for suspending the nested trash bags in said container interior in open configuration.

* * * * *